US005775523A

United States Patent [19]

Teringo

[11] Patent Number: 5,775,523

[45] Date of Patent: Jul. 7, 1998

[54] SHELF ORGANIZER WITH FENCE

[76] Inventor: William M. Teringo, PDMP, 105 Loudoun St. SW., Leesburg, Va. 22075

[21] Appl. No.: 738,550

[22] Filed: Oct. 28, 1996

[51] Int. Cl.[6] ..... A47F 7/00

[52] U.S. Cl. ..... 211/184; 211/11

[58] Field of Search ..... 211/184, 11, 43; 108/60, 61

[56] References Cited

U.S. PATENT DOCUMENTS

| | | | |
|---|---|---|---|
| 2,820,684 | 1/1958 | Zadek et al. | 211/184 X |
| 3,039,836 | 6/1962 | Larson | 211/184 X |
| 3,484,226 | 12/1969 | Golightly | 211/184 X |

FOREIGN PATENT DOCUMENTS

| | | | |
|---|---|---|---|
| 510942A1 | 10/1992 | European Pat. Off. | 211/184 |

*Primary Examiner*—Alvin C. Chin-Shue
*Assistant Examiner*—Sarah Purol
*Attorney, Agent, or Firm*—Terrance L. Siemens

[57] ABSTRACT

A modular shelf organizer for partitioning a shelf. The organizer includes a plurality of trays each having a floor and four short upright walls, and a fence for spanning adjacent trays. The fence forms a storage compartment between two trays, and prevents stored items from rolling off the shelf. The fence comprises one or more fence members further comprising a short wall having a plurality of slots. Corresponding slots are formed in right and left lateral walls of the tray. Fence members can therefore attach to a tray by friction and gravity, and are manually removable therefrom. Supports are provided to support otherwise unsupported fence members where fence members are arranged in series between two adjacent trays. A support has a slot for receiving one or two fence members, and a flared opening for guiding a fence member into the slot. Each tray has interior subdividers which interconnect in a manner similar to that attaching fence members to trays. Both trays and fence member supports have fastening material, such as adhesive or hook and loop material for securing trays and fence member supports permanently to a shelf.

12 Claims, 2 Drawing Sheets

54
62
58
52
60
56

40
38
44
46
38

38
52
38

12 or 16
74
72

40
50
46
44

40
2
66
70
68

36
16

38
36
48
42
40
46
44
40
64

SHELF ORGANIZER WITH FENCE

BACKGROUND OF THE INVENTION

1. Field of the Invention

The present invention relates to apparatus for subdividing horizontal storage and display shelves into compartments having vertical walls. More particularly, the invention includes both trays of fixed, predetermined dimensions and also members for spanning adjacent trays and securing the same at selective, fixed intervals. The spanning members are arranged to form a front wall or fence for preventing stored items from rolling off the subdivided shelf.

2. Description of the Prior Art

Storage and display shelving is usually designed and manufactured for general purposes, rather than being dedicated to a single purpose. For this reason, it is not feasible to provide structure subdividing each shelf into suitable or appropriate compartments for any one particular situation. Shelving and storage devices may be provided with integral, permanent partitions for subdividing the shelf or an equivalent horizontal supporting surface into compartments. However, in most instances, such partitions are either not adjustable, or are arranged to subdivide the shelf into compartments which are excessively small.

A principal example of shelves which are frequently susceptible to the need for selective partitioning is found in medicine cabinets. Unlike parts storage bins utilized to organize and store small fasteners and other small articles, medicine cabinets may be required to store articles of vastly differing dimensions, configurations, and purposes. Personal care articles such as brushes, fluid containers, and generally cylindrical medication and other containers are frequently stored together in medicine cabinets.

Organizing, separating, and grouping such articles enables ready retrieval of each particular item or type of item. The prior art has suggested various devices for installing in a pre-existing medicine cabinet for subdividing the various shelves. In most cases, each prior art device includes a frame insertable into an opening of a medicine cabinet and capable of receiving drawers or shelves. Examples are seen in U.S. Pat. Nos. 2,450,337, issued to Frank T. Hearst on Sep. 28, 1948, 5,255,971, issued to William J. Aisley on Oct. 26, 1993, 5,405,196, issued to Curtis C. Shoup et al. on Apr. 11, 1995, and 5,524,980, issued to Terry A. Carter et al. on Jun. 11, 1996. In each case, a surrounding frame is provided, the frame accommodating shelves or drawers which slidably interfit therewith. By contrast, the present invention provides an arrangement of shelves and interfitting connecting vertical walls which are attached to pre-existing shelves. Unlike the prior art, the present invention subdivides each shelf, and is not dependent upon cooperation with slots or grooves for receiving shelves, vertical walls, and other pre-existing structure. In particular, no surrounding frame is necessary in the present invention.

U.S. Pat. No. 2,359,797, issued to Morris Schnider on Oct. 10, 1944, illustrates a holder or tray which is attachable to a vertical surface. This device exemplifies drawers or trays which could be placed onto shelves for subdividing the same. However, even if Schnider's holder were so utilized, it lacks structure for adjustable configuration and also lacks means for attachment to the shelf. By contrast, both features are found in the present invention.

None of the above inventions and patents, taken either singly or in combination, is seen to describe the instant invention as claimed.

SUMMARY OF THE INVENTION

The present invention subdivides pre-existing medicine cabinets and similar storage and display devices provided with horizontal shelves in ways which better cooperate with pre-existing structure than prior art devices. In particular, the novel shelf organizer has members for connecting trays at selective intervals.

These members provide a further function. They form vertical walls only towards the front of the shelf, or that portion nearest a person facing the medicine cabinet. Vertical walls so oriented provide the function of preventing small objects from rolling off the shelf. Therefore, they create, in effect, a partitioned space or area between two adjacent trays. This both increases the number of partitioned spaces without requiring additional trays, and also enables selective dimensioning of such spaces.

The floor area of a tray is fixed. However, distance spanned by the vertical members, or fence, between two adjacent trays is adjustable. Adjustment is provided by forming a series of spaced apart slots in each vertical or fence member. The fence member may engage a tray at any one selected slot. Therefore, the novel shelf organizer may be utilized with any pre-existing medicine cabinet including those having permanent or integral, non-removable shelves. The organizer need not anticipate dimensions of the medicine cabinet since it adjusts in width.

In a further adjustment, individual trays may be subdivided by short partitions. In a manner similar to fence members, short partitions also have plural slots for interlocking at selected locations. Thus, individual compartments formed within any one tray are selectively variable in dimension.

The fence member may extend a considerable length along the shelf by arranging several fence members in series. posts for supporting fence members are provided to accommodate serial extension of the fence member.

The organizer is optionally adhered to a shelf permanently by adhesive backing or removably by hook and loop fastener. This feature resists inadvertent displacement of the novel organizer.

Accordingly, it is a principal object of the invention to provide a shelf organizer for subdividing or partitioning a pre-existing medicine cabinet.

It is another object of the invention to cooperate with pre-existing cabinet dimensions.

It is a further object of the invention to cooperate with cabinet shelves which are permanent.

Still another object of the invention is to enable adjustment of width of the shelf organizer.

An additional object of the invention is to define additional compartments on a shelf without requiring additional trays.

It is still a further object to subdivide individual trays of the novel organizer.

It is again an object of the invention to extend the fence member by arranging plural fence members in series.

Yet another object of the invention is to adhere the novel organizer to its shelf.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
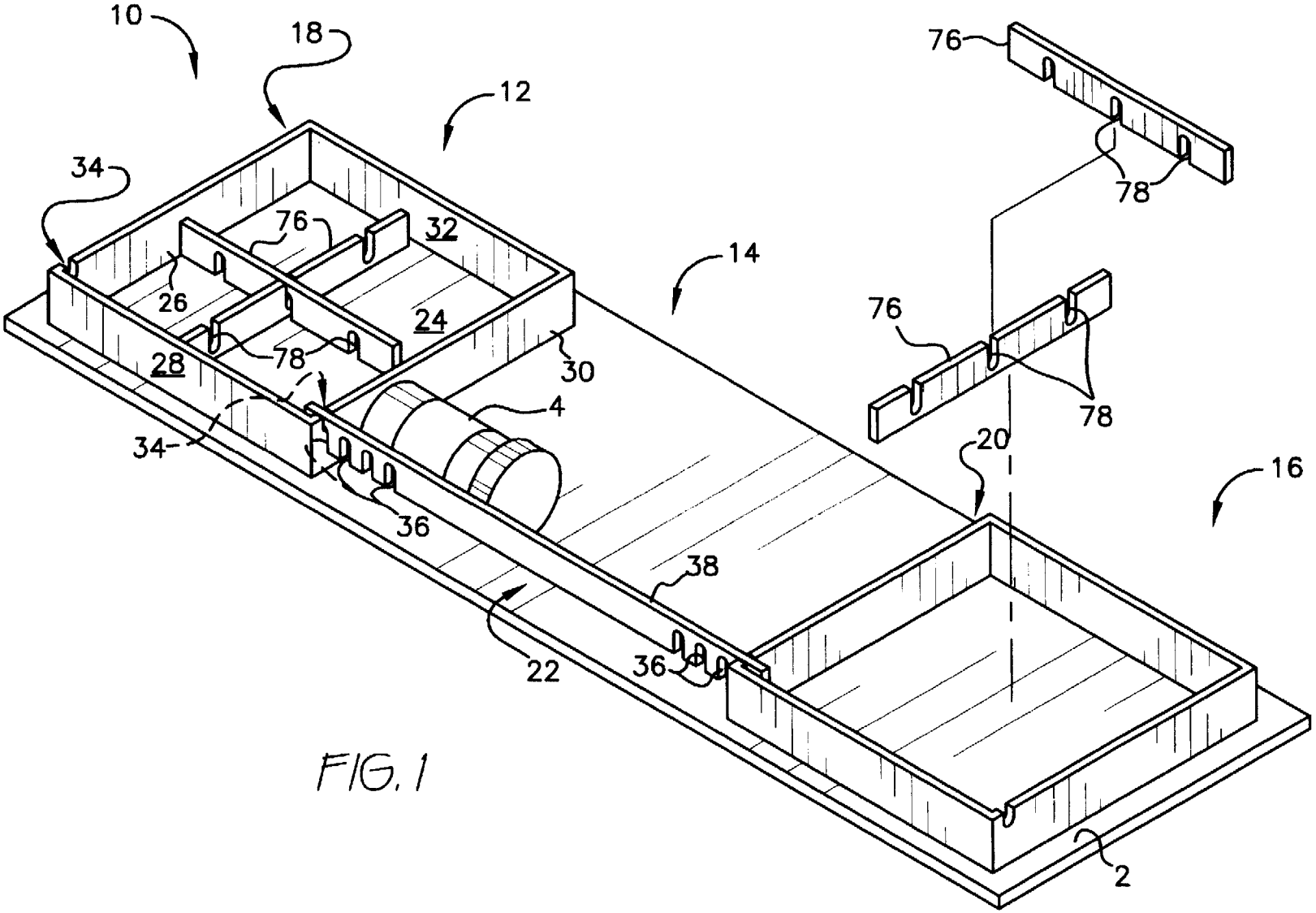
FIG. 1 is an environmental, perspective, partially exploded view of the invention.

FIG. 1 of the drawings shows novel shelf organizer generally designated at 10 assembled on a shelf 2. Organizer 10 is preferably employed with a structure such as a medicine cabinet (not shown in its entirety), which typically includes a rear wall and right and left lateral walls, in addition to one or more horizontal storage shelves or similar environmental surfaces disposed beneath and abutting components of organizer 10. These walls would restrain objects from falling from shelf 2 in the respective directions. Organizer 10 provides the function of subdividing or partitioning shelf 2 into compartments 12, 14, 16.

Organizer 10 in the embodiment depicted includes trays 18, 20 and a fence 22. Compartments 12 and 16 are defined within trays 18 and 20, respectively. Compartment 14 is defined between trays 18 and 20.

Each tray 18 or 20 has a floor 24 and four short upright walls 26, 28, 30, 32. At the junctures of wall 28 and adjacent walls 26 and 30 are located slots 34. Slots 34 have the function of engaging fence 22 and maintaining the same in a vertical orientation, projecting outwardly from tray 12 or 16. Fence 22 is supported by tray 18 or 20 such that more than half of fence 22 is located exteriorly of upright walls 26, 28, 30, 32 of tray 18 or 20. Cooperating slots 36 are formed in fence 22 to accomplish attachment and support of fence 22. Slots 34 and 36 correspond to one another both in dimensions, thereby allowing interfitting as shown in FIG. 1, and also in orientation. That is, slots 34 are open upwardly and slots 36 open downwardly, so that they may be assembled to one another such that the upper surfaces of wall 30 of each tray 12 or 16 and of fence 22 are flush after fence 22 is fully seated or assembled to a tray 12 or 16. After assembly, fence 22 is removably secured to a tray 12 or 16 by gravity. If desired, slots 34 and 36 may be dimensioned to maintain assembly by friction.

Figures 2, 3, 4, 5, 6, 7, 8, 9:
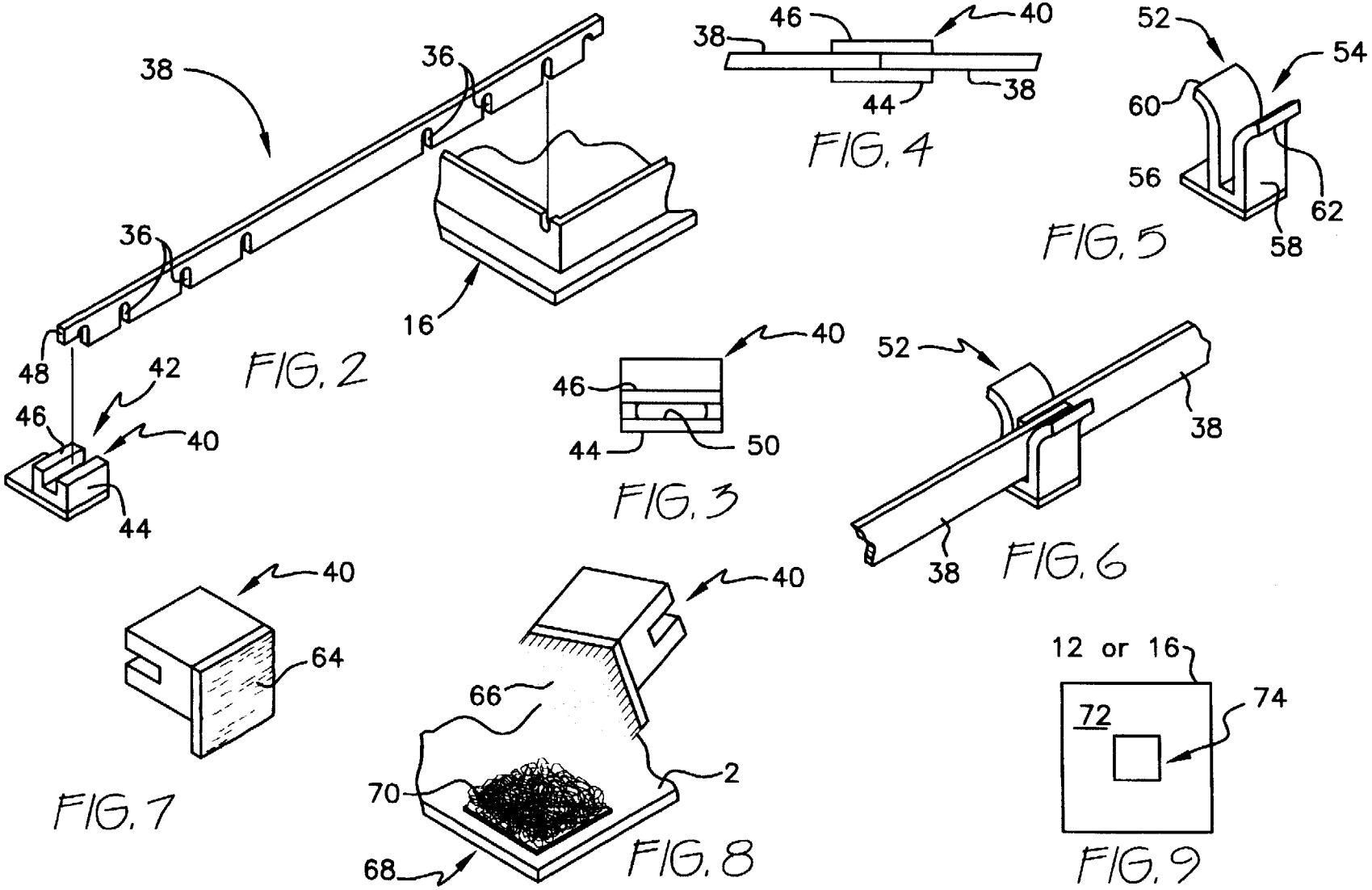
FIG. 2 is a perspective detail view of a connecting member shown at the center of FIG. 1, illustrating anchorage of the connecting member at a tray and also at a supporting member.
FIG. 3 is a top plan detail view of the supporting member shown in FIG. 2.
FIG. 4 is a top plan view of the supporting member seen in FIG. 3, showing two abutting connecting members simultaneously anchored thereto.
FIG. 5 is a perspective detail view of an alternative embodiment of the supporting member shown at the left of FIG. 2.
FIG. 6 is a perspective detail view of the supporting member of FIG. 5, showing two connecting members supported therein.
FIG. 7 is a bottom perspective view of the supporting member of FIG. 3, illustrating adhesive fastening.
FIG. 8 is a bottom perspective view of an alternative embodiment of the supporting member of FIG. 3, illustrating hook and loop fastening.
FIG. 9 is a bottom plan view of a tray typical of those shown at the left and right of FIG. 1.

Fence 22 comprises one or more fence members 38, which may be utilized individually, as depicted in FIG. 1, or in series (see FIG. 4). Fence member 38 is a vertical wall having slots 36. The principal purpose of fence 22 is to establish a barrier preventing items such as cylindrical container 4 from rolling off shelf 2 at the front of the associated medicine cabinet. Since medicine cabinets typically have a rear wall and side walls, escape of items in those directions is not a problem. However, the front of each shelf of a medicine cabinet affords opportunity for items such as container 4 to escape.

organizer 10 is modular, in that individual elements are readily manually assembled and disassembled. Any desired number of trays 12 or 16 and fence members 38 may be assembled as desired. They may be assembled in any selected order so as to offer many different configurations. It would be possible, for example, to utilize a single tray 12 or 16, and to assemble one fence member 38 to each lateral side of the tray 12 or 16, although this arrangement is not shown. It would be further possible to modify the arrangement of FIG. 1 to include additional fence members 38, one fence member 38 projecting to the left of tray 12 and another fence member 38 projecting to the right of tray 16. Thus it will be seen that organizer 10 is quite versatile in subdividing shelves of different widths.

It may further be desired to position fence members in series, so that fence 22 spans a greater distance than the length of one fence member 38. As shown in FIG. 2, this arrangement is accommodated by utilizing a support member or post 40. Post 40 sits on shelf 2 (see FIG. 1) at a predetermined distance from tray 16. A groove 42 formed between first and second walls 44, 46 (respectively) of post 40 receives support member 38. Fence member 38 is inserted into groove 42 until downwardly directed projection 48 of fence member 38 seats in a bore or opening (see FIG. 3) formed at the bottom of groove 42 for partially interlocking fence member 38 to post 40.

Bore 50 is clearly seen in FIG. 3. It will further be seen that bore 50 is sufficiently long to accommodate simultaneous insertion of abutting fence members 38 disposed in series, as shown in FIG. 4. The ends of the two fence members 38 not shown in FIG. 4 may be supported either at an additional tray 12 or 16, in the manner illustrated in FIG. 1, or at another post 40 (not shown) in a manner similar to that illustrated in FIG. 2 or FIG. 4.

Post 40 may take other forms. As seen in FIG. 5, post 52 has a groove 54 of greater width than that of post 40. Greater width accommodates assembly of two fence members 38 abreast of one another, as seen in FIG. 6. Walls 56 and 58 each have an inclined section 60 or 62 (respectively) which collectively form a flared opening for guiding fence members 38 into groove 54.

It is possible to place trays 12, 16 and fence members 38 onto shelf 2 without adhering these components in place. However, it is greatly preferred to adhere organizer 10 to shelf 2. To this end, each post 40 has a lower surface lined with adhesive 64, as seen in FIG. 7. Adhesive may be provided by double sided foam tape having a release liner provided on each side. A product available from 3M Consumer Stationery Division of St. Paul, Minnesota, and identified as Cat. 111, has proved satisfactory for permanent mounting to shelf 2.

In an alternative embodiment shown in FIG. 8, post 40 has a lower surface lined with hook and loop material 66. A patch of material 68 bearing corresponding hook and loop material 70 is permanently adhered to shelf 2. The embodiment of FIG. 8 enables periodic removal and cleaning of trays 12 and 16 and shelf 2.

Of course, trays 12 and 16 and posts 52 are also provided with either adhesive or hook and loop material for adhering to shelf 2. As seen in FIG. 9, the bottom surface 72 of floor 24 of each tray 12 or 16 is provided with an adhering member 74 which could be adhesive, hook and loop material, or any other suitable fastening material.

Organizer 10 may be utilized in the forms described above. However, it is also possible to further subdivide or partition each tray 12 or 16. Referring again to FIG. 1, at least two tray subdividers 76 are provided. Subdividers 76 function similarly to fence members 38, having a vertical wall and slots 78. When assembled together, one subdivider 76 is inverted relative to the other, so that respective slots 78 correspond in the manner of slots 34 of tray 12 or 16 and slots 36 of fence member 38. When two subdividers 76 are assembled together, they will support one another with their respective walls upright or vertical.

It is to be understood that the present invention is not limited to the embodiments described above, but encompasses any and all embodiments within the scope of the following claims.

I claim:

1. A shelf organizer for partitioning a horizontal storage shelf into compartments, comprising:

a fence comprising a fence member further comprising a vertical wall; and a tray having attachment means for supporting said fence member in vertical orientation projecting outwardly from said tray.

2. The shelf organizer according to claim 1, said attachment means comprising a slot formed in said fence member and a corresponding slot formed in said tray, whereby said fence member is removably secured to said tray by gravity, with more than half of said fence member located exteriorly of said tray for preventing stored items from rolling off of said horizontal storage shelf.

3. The shelf organizer according to claim 1, further comprising a second tray having attachment means for supporting said fence member in vertical orientation projecting outwardly from said tray, whereby said fence member spans and is supported at said first tray and at said second tray.

4. The shelf organizer according to claim 3, said fence comprising a second fence member and a post having means for supporting said first fence member and said second fence member, whereby said first fence member and said second fence member are each supported at one said tray and also at said post.

5. The shelf organizer according to claim 4, said post having a lower surface and means for adhering said lower surface to a horizontal environmental surface beneath and abutting said floor.

6. The shelf organizer according to claim 4, said post having a groove for receiving said first fence member and said second fence member, said groove having a flared opening for guiding said first fence member and said second fence member into said groove.

7. The shelf organizer according to claim 4, said fence member having a downwardly directed projection, and said post having a bore for receiving said projection of said fence member, whereby said fence member partially interlocks with said post.

8. The shelf organizer according to claim 1, said tray further comprising at least two tray subdividers each having a vertical wall and corresponding second slots.

9. The shelf organizer according to claim 1, said tray having a floor and means for adhering said floor to a horizontal environmental surface beneath and abutting said floor.

10. A shelf organizer for partitioning a horizontal storage shelf into compartments, comprising:

a fence comprising a fence member further comprising a vertical wall having downwardly directed slots;

a tray having peripheral upright walls, a floor, means for adhering said floor to a horizontal environmental surface disposed beneath and supporting said tray, and corresponding upwardly directed slots for supporting said fence member in vertical orientation projecting outwardly from said tray; and a post having means for supporting said fence member, whereby said fence member is supported selectively at said tray and at said post, a lower surface, and means for adhering said lower surface to a horizontal environmental surface disposed beneath and supporting said post, said fence member having a downwardly directed projection, and said post having a bore for receiving said projection of said fence member, whereby said fence member partially interlocks with said post.

11. The shelf organizer according to claim 10, said post having a groove having a flared opening for guiding said fence member into said groove.

12. The shelf organizer according to claim 10, said tray further comprising at least two tray subdividers each having a vertical wall and corresponding second slots.

* * * * *